US005103246A

United States Patent [19]

Dunn

[11] Patent Number: 5,103,246

[45] Date of Patent: Apr. 7, 1992

[54] X-Y MULTIPLEX DRIVE CIRCUIT AND ASSOCIATED INK FEED CONNECTION FOR MAXIMIZING PACKING DENSITY ON THERMAL INK JET (TIJ) PRINTHEADS

[75] Inventor: John B. Dunn, Corvallis, Oreg.

[73] Assignee: Hewlett-Packard Company, Palo Alto, Calif.

[21] Appl. No.: 657,343

[22] Filed: Feb. 15, 1991

Related U.S. Application Data

[63] Continuation of Ser. No. 449,655, Dec. 11, 1989, abandoned.

[51] Int. Cl.[5] ..... B41J 2/05; B41J 2/175

[52] U.S. Cl. ..... 346/140 R

[58] Field of Search ..... 346/140, 1.1

[56] References Cited

U.S. PATENT DOCUMENTS

| | | | |
|---|---|---|---|
| 4,438,191 | 3/1984 | Cloutier | 346/140 X |
| 4,558,333 | 12/1985 | Sugitani | 346/140 |
| 4,630,076 | 12/1986 | Yoshimura | 346/140 |
| 4,695,853 | 9/1987 | Hackleman | 346/140 |
| 4,746,935 | 5/1988 | Allen | 346/140 |
| 4,914,736 | 4/1990 | Matsuda | 346/140 |
| 4,922,269 | 5/1990 | Ikeda | 346/140 |

*Primary Examiner*—Joseph W. Hartary

[57] ABSTRACT

A X-Y multiplex drive circuit and associated ink feed arrangement for an ink jet printhead wherein resistive heater elements, X-Y electrical interconnects thereto and closely adjacent ink feed ports are integrated on or within a given printhead substrate surface area with a maximum packing density and a minimum of fluidic crosstalk. Ink feed channels are formed within a printhead barrier layer which separates an ink jet orifice plate from an underlying printhead substrate, and state-of-the-art MOS planar processes and thin film deposition processes may be used for fabricating this drive circuit and its associated ink feed arrangement.

3 Claims, 3 Drawing Sheets

X-Y MULTIPLEX DRIVE CIRCUIT AND ASSOCIATED INK FEED CONNECTION FOR MAXIMIZING PACKING DENSITY ON THERMAL INK JET (TIJ) PRINTHEADS

This is a continuation of copending application Ser. No. 07/449,655 filed on Dec. 11, 1989, now abandoned.

TECHNICAL FIELD

This invention relates generally to the integration of thermal ink jet (TIJ) printheads with connecting drive circuitry and more particularly to an integrated multiplexed heater resistor drive circuit for a TIJ printhead for optimizing the use of thin film device surface area of the printhead.

BACKGROUND ART

In the field of thermal ink jet printhead circuit design for providing the circuitry necessary to drive printhead heater resistors, early approaches used separate electrical interconnects for the individual heater resistors. These approaches obviously imposed a significant limitation on resistor and interconnect packing density achievable on a given area of the printhead substrate surface. In an effort to increase this packing density relative to these early approaches, various designs have been suggested for integrating electrical drive circuitry and thin film heater resistors on a thermal ink jet printhead. One such design and construction is disclosed in U.S. Pat. No. 4,532,530 issued to Hawkins wherein it is proposed to utilize polycrystalline silicon feed lines on an integrated circuit substrate to electrically connect into the thermal ink jet printhead heater resistors. This approach allows the drivers and logic circuits to be cofabricated in the same steps used to manufacture the printhead.

Another construction for integrating drive circuitry with a thermal ink jet printhead is disclosed in U.S. Pat. No. 4,695,853 issued to Hackleman et al and assigned to the present assignee. In this latter approach, an X-Y multiplexing circuit is connected on a common integrated circuit chip with vertically constructed heater resistors and multiplexing diodes to selectively switch the diodes and resistors from conduction to non-conduction during a multiplexing operation.

In both of the above types of construction and other known methods of thermal ink jet printhead construction and driver circuit integration, the driving circuitry is located on one area of the thin film printhead substrate, and the heater resistors are located on another area of the printhead substrate. These design approaches still impose a significant limitation on the achievable packing density of both heater resistors and associated driving circuitry on a given printhead device surface area.

DISCLOSURE OF INVENTION

An object of this invention is to further maximize the achievable packing density of both heater resistors and associated drive circuitry in a novel integrated circuit arrangement on a common underlying substrate. This is achieved by the provision of a thermal ink jet printhead and multiplex circuit therefor which includes a plurality of resistive heater elements arranged on a given area of a supporting substrate. A corresponding plurality of ink flow ports are formed within the substrate and feed ink delivery channels surrounding the corresponding resistive heater elements for supplying ink thereto during an ink jet printing operation. There is also provided X-Y matrix drive circuitry on the same area of the substrate as the resistive heater elements and ink flow ports. Such circuitry includes a plurality of X lines which are connected to one side of each of the resistive heater elements and a plurality of Y lines which are connected to another side of each of the resistive heater elements.

The X and Y lines are electrically insulated from one another using known double level metal (DLM) and film deposition techniques, and each of the X and Y lines is capable of simultaneously driving a plurality of the resistive heater elements. These lines are connected in close proximity to the heater elements and their associated ink feed ports and are integrated within the same general surface area of the thin film device in which the heater elements are formed. Thus, this arrangement maximizes the packing density of the combination of: (1) the resistive heater elements, (2) the X-Y matrix drive multiplex circuitry, and (3) the associated ink delivery ports and connecting channels, thereby achieving an overall optimized packing density for the thermal ink jet printhead.

Another object of this invention is to provide a new and improved printhead of the type described which operates with good ink refill rates and a good frequency response.

Another object is to provide a new and improved ink jet printhead multiplex circuit and associated ink feed structure which operates with a minimum of fluidic crosstalk.

A feature of this invention resides in the construction of a novel integrated multiplexed thermal ink jet printhead capable of manufacture using state-of-the-art thin film deposition and pattern forming techniques for defining the resistive heater elements, barrier layers and multi-level metallization for the X-Y multiplex circuitry.

Another novel feature of this invention resides in the utilization of vertical ink flow ports which are spaced in close proximity to each of the resistive heater elements and their associated X-Y multiplexing circuitry in a given area of a thin film printhead. Advantageously, these vertical ink flow ports may be formed using state-of-the-art laser drilling processes.

The above objects, novel features and various related advantages of this invention will become more readily apparent in the following description of the accompanying drawings.

BRIEF DESCRIPTION OF THE DRAWING

Referring now to FIG. 1, there is shown a three color and black ink jet pen which is generally designated as 10 and includes an orifice or nozzle plate 12 which is secured to an adjacent barrier layer 14. The barrier layer 14 is typically formed of a polymer material such as VACREL and is secured to a thin film resistor (TFR) substrate 16 in which the X-Y multiplex driving circuit herein is integrated as described below.

Figure 1:
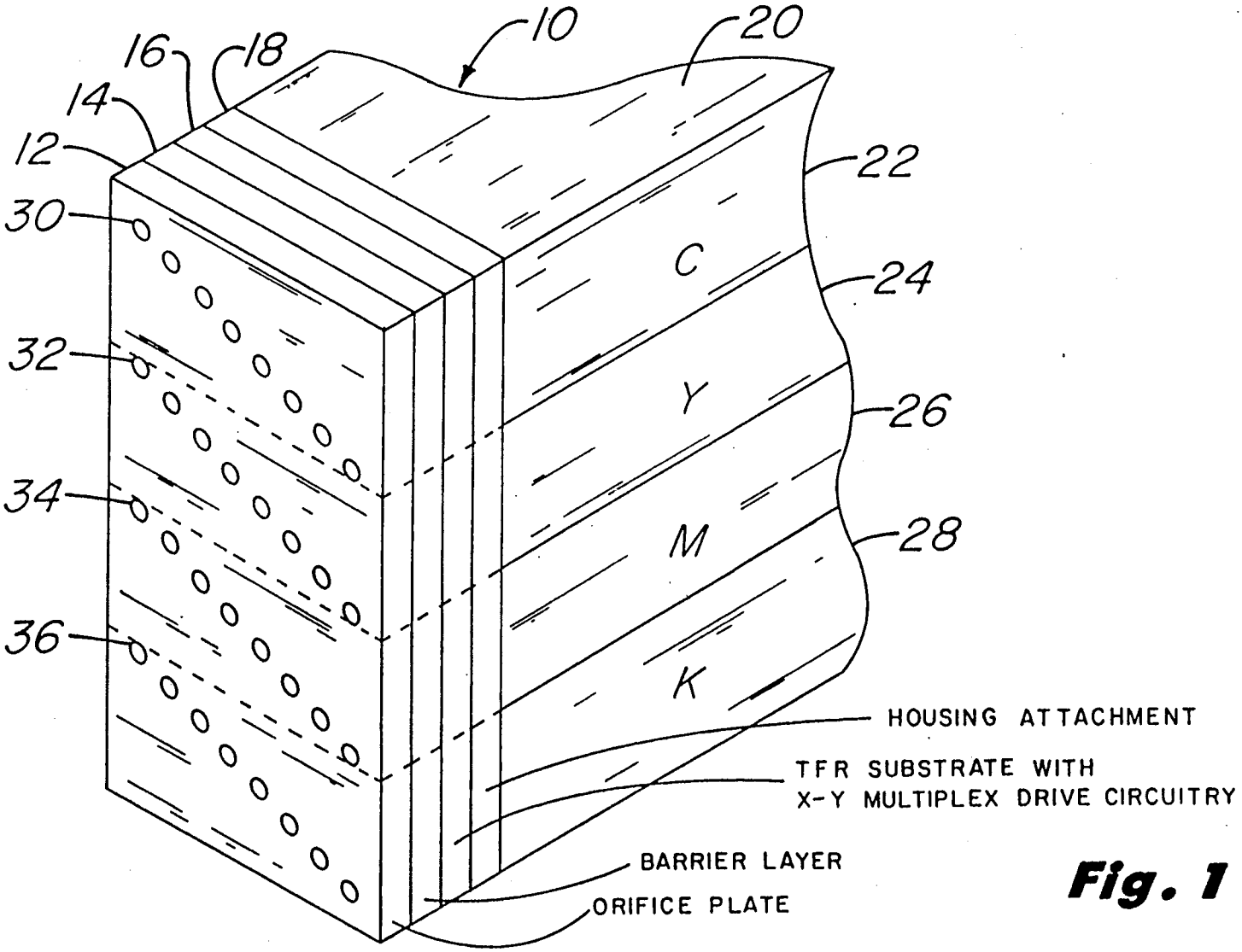
FIG. 1 is an isometric view of a thermal ink jet (TIJ) pen in which the present invention may be employed.

The TFR substrate 16 rests on a housing attachment layer 18 which serves to affix the TFR substrate 16 to an ink supply housing 20. The housing 20 will typically have four (4) ink storage compartments 22, 24, 26, and 28 therein for storing cyan (C), yellow (Y), magenta (M), and black (K) colors of ink in a well-known manner. This ink storage may be accomplished using a polyurethane foam material in the compartments 22, 24, 26, and 28, and the techniques used for foam storage and pen body housing construction are disclosed, for example, in U.S. Pat. No. 4,771,295 issued to Jeffrey P. Baker et al and in U.S. Pat. No. 4,812,859 issued to C. S. Chan et al, both assigned to the present assignee and incorporated herein by reference.

The orifice or nozzle plate 12 has four (4) angled rows 30, 32, 34, and 36 of eight (8) nozzles each, and these nozzles are fluidically coupled to the vertical ink feed ports, adjoining horizontal channels and heater resistors described below in FIG. 2.

Figure 2:
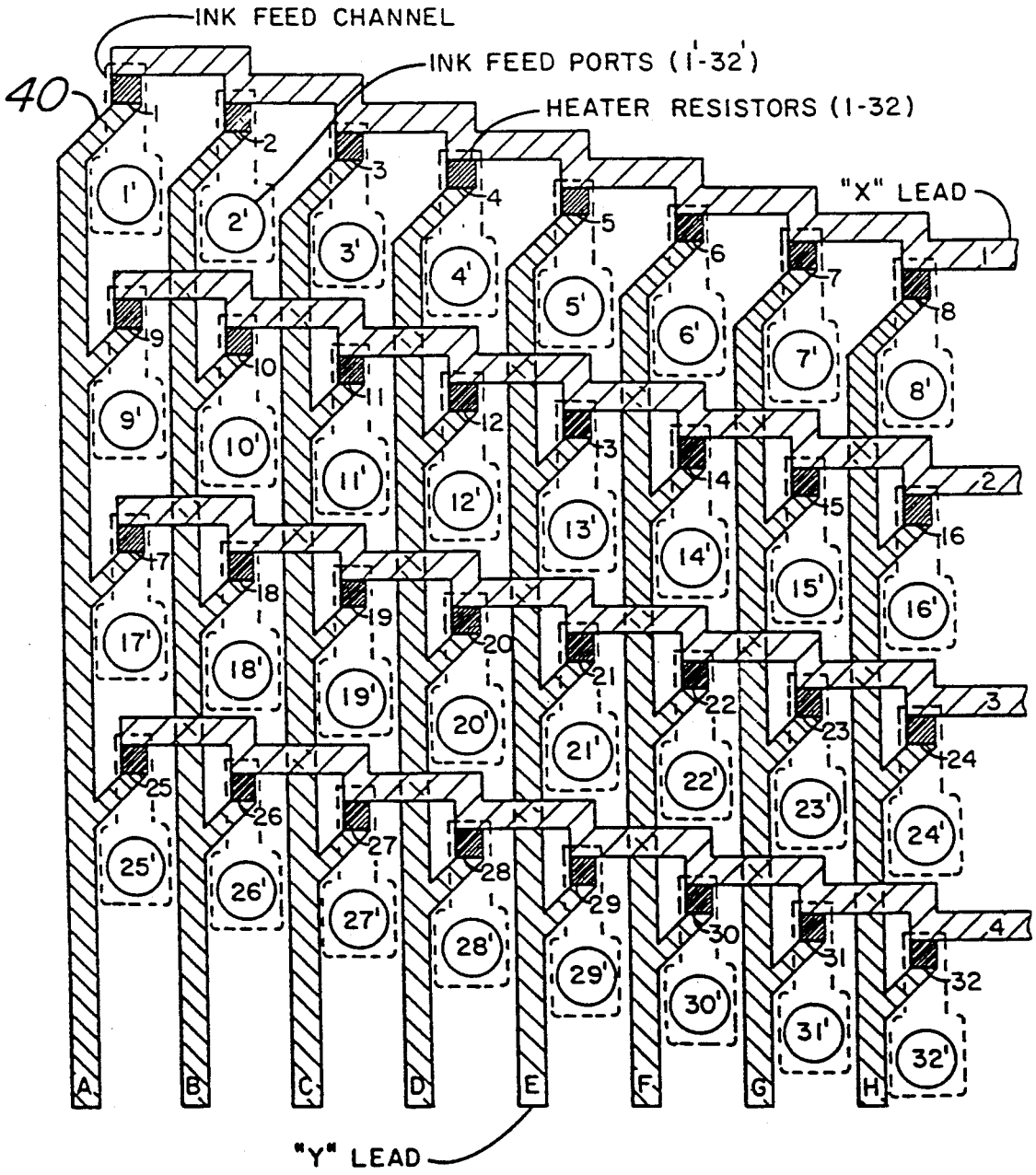
FIG. 2 is a hybrid electrical wiring and associated ink feed diagram for the X-Y multiplex circuit according to the invention.

Referring now to FIG. 2, this figure shows a schematic electrical and fluidic (ink coupling) combination diagram which is shown in a topographical layout on the surface of a thermal ink jet printhead substrate. The specific processes for forming the electrical interconnections, the insulation and passivation layers for these interconnections, and the barriers defining the ink feed channels for this structure have not been given in any detail herein, since such process details are not necessary to support and understand the claims being made herein. The fabrication processes required for forming all of these integrated components are well known in the semiconductor, thin film and planar metal-on-semiconductor (MOS) technologies and are described and referenced in more detail below.

Referring again to FIG. 2, there is shown an X-Y multiplex circuit according to the present invention which includes four (4) angled and spaced parallel rows of eight (8) heater resistors identified as R1 through R32 which have been photodefined on or within a underlining substrate consisting typically of silicon, glass, or other suitable insulating material such as MYLAR. These heater resistors may, for example, be fabricated of tantalum aluminum and have their X-Y dimensions photolithographically defined using well-known ink jet heater resistor fabrication processes. Such processes are described, for example, in U.S. Pat. No. 4,809,428 issued to Stephen Aden et al, assigned to the present assignee and incorporated herein by reference. These processes are also described in the *Hewlett Packard Journal*, Volume 36, No. 5, May 1985, and also in the *Hewlett Packard Journal*, Volume 39, No. 4, August 1988, both also incorporated herein by reference.

These heater resistors R1–R32 will either be aligned with or slightly offset with respect to the rows of orifice openings 30, 32, 34, and 36 in the overlying orifice plate 12 shown in FIG. 1. When energized by a driving pulse of current, these heater resistors operate to propel ink by nucleation through the orifice openings in the orifice plate 12 and onto an adjacent print medium. Orifice plate alignment and mounting with respect to these heater resistors is well known in the art and is also described in some detail in the above identified *Hewlett Packard Journals*. Such alignment is also described in U.S. Pat. No. 4,746,935 issued to Ross R. Allen, assigned to the present assignee and incorporated herein by reference.

The resistors R1–R8 in the top row of resistors in FIG. 2 are connected on their top side with a common electrical connection designated as Lead 1, and the other horizontal Leads 2, 3, and 4, respectively, provide a common connection for the adjacent rows of heater resistors R9–R16, R17–R24, and R25–R32. These four (4) rows of heater resistors are connected on their lower sides by the eight (8) vertical leads designated as Leads A through H. These Leads A through H are offset somewhat to the left of the heater resistors as shown in FIG. 2 and are interconnected to these resistors by the spur connections 40 which extend at an angle from each of the eight (8) vertical Leads A through H. The eight vertical Leads A through H cross over and are insulated from the horizontal Leads 1 through 4 using well-known double level metallization (DLM) processing techniques not described herein in detail, and the vertical Leads A through H are offset to the left of the vertical columns of heater resistors as shown. This is done in order to make room for a plurality of ink feed ports which extend into the substrate and are connected to remote ink supplies (not shown). There is one ink feed port associated with and fluidically coupled to each one of the thirty-two (32) resistors R1–R32.

The vertical Leads A–E cross over the horizontal Leads 1–4 and are insulated therefrom by a suitable insulating layer (not shown) such as silicon dioxide, silicon nitride or silicon carbide or some composite combination thereof, and are themselves photodefined in both length and width using known photolithographic and metal deposition processes.

The vertical cylinders or ink feed ports IF 1–IF 32 are formed in the underlying substrate using processes well-known in the art such as laser drilling, sandblasting, or chemical etching. Out of these processes, laser drilling has been found to be the most effective of the alternatives and may be achieved by focusing a high powered Q switched YAG laser with a very small beam spot size on the substrate material being drilled. These laser drilling techniques are described in more detail in the above identified *Hewlett Packard Journal*, Volume 39, No. 4, August 1988, at pages 28–31. The ink feed ports associated with each row of heater resistors may be connected respectively by way of suitable ink passageways to the C, Y, M, and K compartments in the ink supply housing shown in FIG. 1. Ink feed construction techniques such as those shown in the above identified U.S. Pat. No. 4,771,295 issued to Baker et al may be used for this fluidic coupling and isolation.

Figure 3:
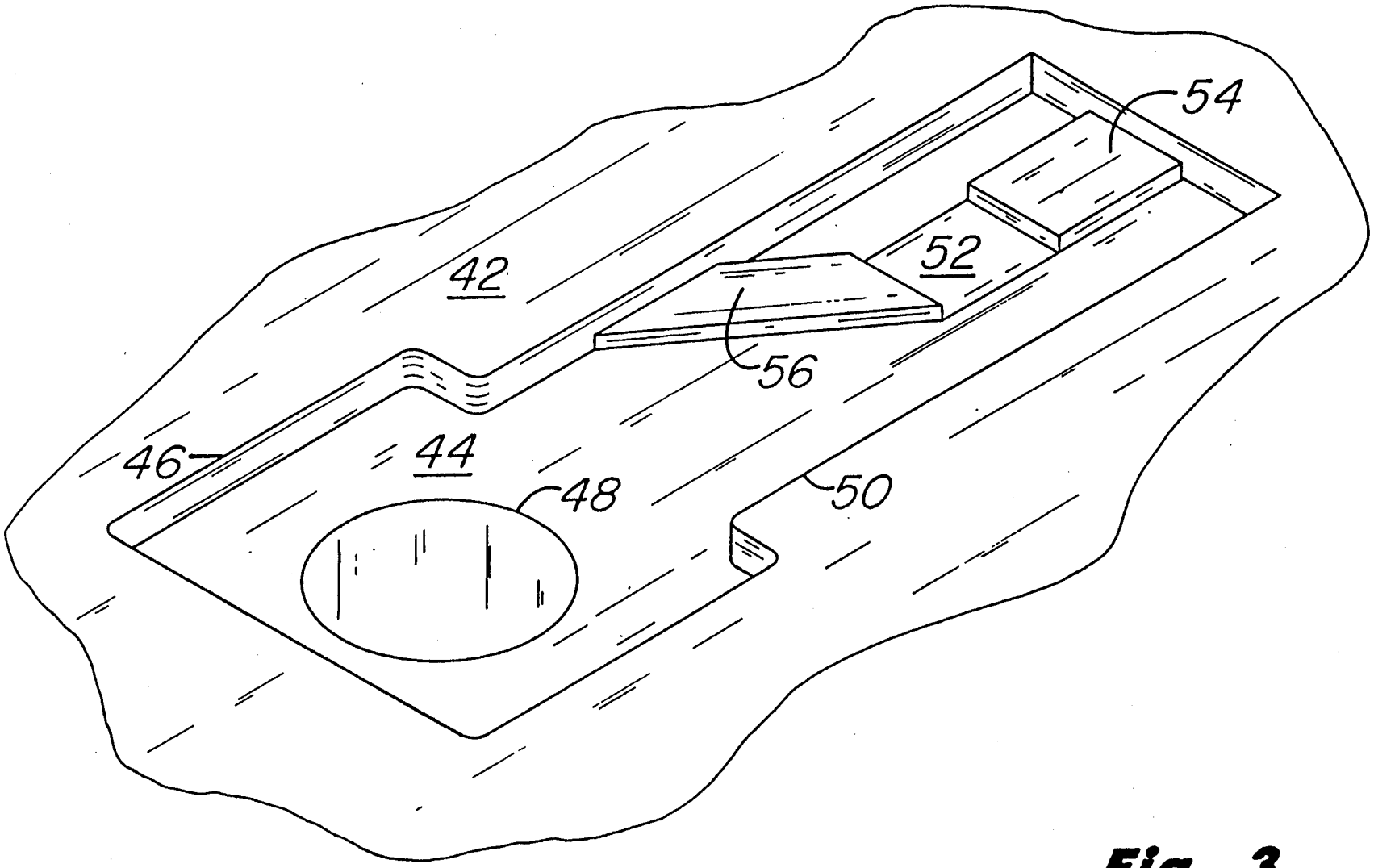
FIG. 3 is an enlarged fragmented isometric view showing the coupling of one vertical ink feed port to one of the heater resistors in FIG. 2.

Each of the feed holes IF1–IF 32 is surrounded by the walls of a barrier layer which has been configured in the geometry shown in FIGS. 2 and 3 to define a separate ink feed channel for each of the heater resistors and to provide a coupling of ink from each vertical ink feed hole or port to the individual heater resistors. Each ink feed channel has been photolithographically defined in the barrier layer 14 in FIGS. 1 and 3 and is shown in enlarged detail in FIG. 3. This barrier layer construction per se is also well-known in the art and is described in some detail in all of the above identified references. The barrier layer will typically be a polyimide material such as VACREL and separates the overlying attached orifice plate from the plane of the X-Y multiplex metallization on the TFR substrate 16 described above.

The vertical ink feed ports should be drilled to a suitable diameter and are spaced from the respective heater resistors. Both the horizontal and vertical X-Y electrical interconnections to the heater resistors may be formed as thin strips of aluminum and the entire novel multiplex circuit and ink feed combination in FIG. 2 may be fabricated within a chosen area on the surface of the thin film resistor substrate 16. Thus, by using the present invention to integrate X-Y current drive and heater resistors and associated ink feed ports and channels on one area of the total available TFR substrate area, the remainder of the substrate area can be used for other functions such as housing integrated decoder circuits and buss lines leading to external off-substrate connections.

In practice, each of the four (4) rows of eight (8) heater resistors may be fluidically connected to receive respectively the primary ink colors of cyan, yellow, magenta, and black (C,Y,M, and K), and the resistors in each row are offset vertically from each adjacent resistor in the same row by a dimension equal to a width dimension of the resistor itself. This vertical offset of adjacent heater resistors in each angled row is made to compensate for the printhead speed as it traverses across a print medium and considered together with the fact that the resistors in each row will sometimes be fired in a sequential manner by drive signals applied by the multiplex circuitry described. This technique of vertically offsetting heater resistors in a given row of heater resistors is known in the art, and the sequential firing of a row of heater resistors will, as a result of printhead travel speed and resistor offset, produce four (4) horizontal lines of cyan, yellow, magenta, and black drops across a printed page.

The Leads 1–4 may be connected to a common bias level or a common point of reference potential, and the Leads A–H may be connected to external pulse drive signals to provide either sequential or simultaneous firing of the heater resistors in each row. Each of the heater resistors may, if desired, incorporate a PN junction therein depending upon the resistive material used or may otherwise be associated with a PN junction diode (not shown) in order to prevent undesirable leakage currents from occurring within the multiplex circuit. Such diode construction, purpose and connection is described for example in the above identified U.S. Pat. No. 4,695,853 issued to David Hackleman et al. When these heater resistors are formed atop or within silicon substrates, it may be desirable to form these isolation diodes by selective diffusion or ion-implantation directly into the substrate material and closely adjacent to the heater resistors.

An insulating barrier layer 42 includes a plurality of elongated bulb-shaped ink feed channels as shown in FIGS. 2 and 3 to provide confined lateral ink flow from the vertical ink feed holes or ports to the individual heater resistors. One of these channels is designated generally as 44 in FIG. 3 and includes an annular head portion 46 which surrounds an ink feed port 48 and further includes a neck portion 50 extending therefrom. The neck portion 50 surrounds a heater resistor 52 to which the X and Y lead lines 54 and 56 are connected. These feed channels 44 provide good fluidic crosstalk isolation between adjacent heater resistors and adjacent fluid coupling thereto. In addition, the use of one ink feed port 48 spaced closely adjacent to each of the heater resistors 52 insures that good ink refill rates are provided after resistor firing, and this in turn results in a good frequency response characteristic for the printhead. Furthermore, and as seen in FIG. 3, the VACREL barrier layer provides good insulation coverage and corrosion protection for all portions of the X and Y multiplex leads except for those ends or terminations which make direct contact with the heater resistors.

In addition to the corrosion protection provided by the VACREL layer, there will usually be provided another dielectric layer (not shown) such as a composite $SiO_2/Si_3N_4$ layer interposed directly between the VACREL barrier layer and the X-Y metallization and underlying TaAl resistive layer in order to provide an added measure of protection for the metallization and heater resistors. In cases where the substrate material directly underlying these leads is a tantalum aluminum resistive layer, the metal lead discontinuity in FIG. 3 serves to define one dimension of the TIJ heater resistor.

Various modifications may be made in the above described embodiment without departing from the scope of this invention. For example, the X and Y leads might be fabricated of materials other than metal, such as polycrystalline silicon. When using polysilicon lead lines, the areas thereof adjacent to the heater resistors can be appropriately doped with an impurity to provide the necessary PN junctions therein and junction isolation for leakage currents.

In addition, the X-Y multiplex circuit according to the invention may be used with piezoelectric transducers instead of heater resistors as will be understood to those skilled in the art. Also, the X-Y circuitry described herein may be rearranged in an annular or circular geometry so as to conform to the contour of nozzles arranged as circular primitives or other non-linear nozzle configurations.

Finally, the present invention is not limited to the exemplary photo-defined thin film deposition processes described above. It may be employed with different types of TFR substrate construction techniques such as, for example, those disclosed and claimed in U.S. Pat. No. 4,847,630 issued to Bhaskar et al, assigned to the present assignee and incorporated herein by reference. In this patent, the resistive heater elements and lead-in connections are integrated and built up on a common substrate starting material in a controlled self-aligning process in which precise alignment between heater resistors, lead lines and ink feed ports is made possible. Furthermore the present invention may be also used with other types of ink storage housings instead of the foam storage type pens. One such alternative housing employing a capillary feed system is shown in U.S. Pat. No. 4,791,438 issued to Gary E. Hanson et al, assigned to the present assignee and incorporated herein by reference.

I claim:

1. A multiplex circuit and associated ink feed structure for use in an ink jet printhead comprising:

a. a plurality of heater resistors arranged on a given area of a supporting substrate, b. a corresponding plurality of ink flow ports extending within said substrate and having output openings spaced adjacent to said heater resistors respectively for supplying ink thereto during an ink jet printing operation, with each heater resistor being separately associated with and fluidically coupled to a separate ink flow port, c. X-Y matrix drive circuitry connected on said given area of said supporting substrate and including a plurality of X lines connected to one side of each of said heater resistors and a plurality of Y lines connected to another side of each of said heater resistors, said X and Y lines being electrically insulated one from another, whereby each of said X and Y lines is capable of electrically driving or providing bias to a plurality of heater resistors on said given surface area of said substrate, and the packing density of said heater resistors, said ink flow ports and said matrix drive circuitry is maximized in an integrated printhead device structure, d. said ink flow ports extend normal to a major surface of said substrate, and said X and Y lines are orthogonally positioned with respect to each other and disposed on said supporting substrate and electrically interconnected to each other adjacent to each ink flow port and heater resistor associated therewith, e. said ink flow channel is defined by walls of a barrier layer which separates an ink ejection orifice plate from said substrate and the X-Y matrix circuitry disposed thereon, f. said ink flow ports extend normal to a major surface of said substrate upon which said heater resistors are disposed and are located between adjacent Y lines connected to each of said heater resistors, and g. said ink flow channel includes a head portion which surrounds an associated ink feed port and an adjoining neck portion which extends therefrom and surrounds an adjacent heater resistor, whereby said ink flow channels fluidically isolate said heater resistors one from another.

2. The structure defined in claim 1 wherein said heater resistors are aligned with respect to multiple rows of orifices, respectively, which are fluidically coupled to receive ink from multiple ink storage compartments, respectively, in an ink jet pen.

3. A thermal ink jet printhead including, in combination:

a. a plurality of rows of thermal ink jet heater resistors disposed within a given area on a supporting substrate, b. a plurality of rows of ink feed ports positioned respectively adjacent to each of said plurality of rows of heater resistors so that one ink flow port is fluidically associated with a corresponding heater resistor in each adjacent row of heater resistors, c. a plurality of Y matrix lines disposed in a column position adjacent to columns of ink flow ports and heater resistors taken from each of said plurality of rows of heater resistors and ink flow ports, d. a plurality of rows of X matrix lines orthogonally positioned with respect to each of said Y matrix lines and extending across said given surface area adjacent to said respective rows of both heater resistors and ink flow ports associated therewith, e. means fluidically coupling each ink flow port to each associated heater resistor for supplying ink thereto during an ink jet printing operation, f. said fluidically coupling means includes a plurality of ink feed channels configured within a barrier layer which is disposed on top of said substrate and wherein said barrier layer is further disposed to receive an overlying orifice plate having ink ejection orifices therein aligned with respect to each of said plurality of heater resistors, and g. each of said ink feed channels configured within said barrier layer includes a head portion which surrounds each associated ink feed port and an adjoining neck portion which extends therefrom and surrounds an adjacent fluidically coupled heater resistor, whereby said ink feed channels serve to fluidically isolate each of said heater resistors one from another.

* * * * *